US007650710B1

(12) United States Patent
Conroy et al.

(10) Patent No.: US 7,650,710 B1
(45) Date of Patent: Jan. 26, 2010

(54) ARTICLE WITH ENHANCED RESISTANCE TO THERMOCHEMICAL EROSION, AND METHOD FOR ITS MANUFACTURE

(75) Inventors: Paul J. Conroy, Chruchville, MD (US); James M. Garner, Belair, MD (US); Charles Leveritt, Jarretsville, MD (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 802 days.

(21) Appl. No.: 10/859,153

(22) Filed: Jun. 3, 2004

(51) Int. Cl.
*F41A 21/22* (2006.01)

(52) U.S. Cl. ..... 42/76.01; 42/76.02; 89/14.05; 89/14.7; 148/207; 148/210; 148/212; 148/225; 148/230; 148/231; 148/317; 148/318; 204/192.1; 204/192.15; 427/248.1; 427/255.11; 427/255.22; 427/255.26; 427/255.394; 427/404; 427/405; 427/419.1; 427/419.7; 428/332; 428/469; 428/698

(58) Field of Classification Search ..... 89/14.05, 89/14.7; 428/698, 469, 332; 42/76.01, 76.02; 148/207, 210, 212, 225, 230, 231, 317, 318; 204/192.1, 192.15; 427/248.1, 255.11, 255.22, 427/255.26, 255.394, 404, 405, 419.1, 419.7
See application file for complete search history.

(56) References Cited

U.S. PATENT DOCUMENTS 2,799,959 A 7/1957 Osborn
4,486,247 A 12/1984 Ecer et al.

(Continued)

OTHER PUBLICATIONS

Fernandez Guillermet et al, "Thermodynamic Analysis of the Fe-N System Using the Compound-Energy Model with Predictions of the Vibrational Entropy", Z. Metallkd. 85 (1994) 3, pp. 154-163.

(Continued)

*Primary Examiner*—Archene Turner
(74) *Attorney, Agent, or Firm*—William V. Adams; Christos S. Kyriakou

(57) ABSTRACT

A body of iron, steel or other such ferrous material is protected from thermochemical erosion by a layer of an iron nitride having a relatively low nitrogen content. The atomic percentage of nitrogen in the iron nitride layer is no greater than 20%, and in specific embodiments is in the range of 10-15%. The nitride layer may have a layer of a refractory material deposited thereatop. Some refractory materials include metals such as chromium. The invention has specific utility for protecting gun barrels, turbines, internal combustion engines, drilling equipment, machine tools, aerospace systems and chemical reactors which are exposed to extreme conditions of temperature and pressure. Specifically disclosed is a gun barrel which incorporates the invention.

35 Claims, 1 Drawing Sheet

U.S. PATENT DOCUMENTS

| | | | | | |
|---|---|---|---|---|---|
| 4,969,378 | A | * | 11/1990 | Lu et al. | 148/212 |
| 4,981,646 | A | * | 1/1991 | Culling | 420/586.1 |
| 5,810,947 | A | | 9/1998 | Wu et al. | |
| 5,887,558 | A | | 3/1999 | Kampichler et al. | |
| 6,025,021 | A | | 2/2000 | Sue | |
| 6,425,966 | B1 | | 7/2002 | Highsmith et al. | |
| 6,497,772 | B1 | * | 12/2002 | Meckel et al. | 148/254 |
| 6,511,710 | B2 | | 1/2003 | Warnecke | |
| 7,191,588 | B2 | | 3/2007 | Conroy et al. | |
| 2002/0104588 | A1 | | 8/2002 | Oglesby | |

OTHER PUBLICATIONS

Firrao, Donato et al. "Fracture of Nitrided and Nitrocarburized Blunt Notch Three-Point Bending Die Steel Specimens" Materials Science and Engineering A 409 (2005) 309-316.

Mandrino, DJ. et al. "Oxide and Nitride Protective Layers Formed on Stainless Steel by Thermal Treatment: SEM, AES, WDS and Corrosion Measurements" Metalurgija 47 (2008) 2, 119-123.

Kurz, Marianne et al. "Formation of Nitride Layers in the Nitrocarburizing of Engine Valves", Daimlerchrysler AG, Stuttgart, Germany, pp. 14-17.

* cited by examiner

ARTICLE WITH ENHANCED RESISTANCE TO THERMOCHEMICAL EROSION, AND METHOD FOR ITS MANUFACTURE

GOVERNMENT INTEREST

The invention described herein may be manufactured, used, and licensed by or for the United States Government.

FIELD OF THE INVENTION

This invention relates generally to methods and structures for enhancing the resistance of ferrous materials to thermochemical erosion. More specifically, the invention relates to a specific iron nitride coating which functions to protect a subjacent steel surface from erosion by high temperature, high pressure atmospheres.

BACKGROUND OF THE INVENTION

Gun barrels, turbine components, internal combustion engine components, aerospace components, chemical reactors, machine tools, drilling equipment, bearings and the like are often comprised of iron, steel or other ferrous alloys. In use, such articles are frequently exposed to various combinations of high temperatures, high pressures and corrosive ambient environments. These conditions can cause thermochemical erosion of the substrate materials leading to pitting, cratering, cracking and failure.

The prior art has recognized such problems and has attempted to prevent or minimize the erosion of ferrous materials by the use of various coatings comprised of high hardness materials. For example, U.S. Patent Application 2002/0104588 discloses a process for extending the life of mechanical centrifuge screens by forming a layer of high hardness iron nitride on the screen and subsequently electroplating a layer of chromium onto the nitride layer. The nitride layers of the '588 application are high hardness layers including at least 33 atomic percent nitrogen. Likewise, U.S. Pat. Nos. 5,887,558 and 5,810,947 show coatings of high hardness iron nitride used in connection with internal combustion engines and machine tools respectively. As will be explained in detail hereinbelow, such prior art methods have been found to be unsuitable for, and in some instances actually derogatory to, enhancing the thermochemical stability of steel and the like under high temperature, high pressure reactive conditions.

The present invention may be utilized to enhance the thermochemical stability of a variety of articles. For the purposes of this present discussion, the invention will be described primarily with regard to gun barrels; however, it is to be understood that the invention may be used with equal advantage in connection with any other articles which are exposed to conditions which include one or more of high temperatures, high pressures and corrosive environments. These articles include, by way of illustration and not limitation, internal combustion engine components, turbine components, aerospace assemblies, chemical reactors, machine tools, drilling equipment, bearings and the like.

Referring now to FIG. 1, there is shown a cross-sectional view of a portion of the bore of a gun barrel 10 of the prior art. The gun barrel 10 is comprised of a body of a steel alloy, and a portion of this body of steel alloy is shown at reference numeral 12. It is to be understood that in some instances gun barrels are fabricated as composite members having a steel liner which defines the gun bore, and this liner is encased in a body of another material such as a body of metal or a body of a reinforced polymer.

The gun barrel 10 shown in FIG. 1 is typical of, and representative of, barrels associated with relatively large artillery pieces as well as small arms. The barrel 10 of FIG. 1 includes a coating of chromium 14 deposited on the surface of the bore thereof. In some instances a gun barrel will have a layer of another refractory material thereatop, or it may not have any refractory material at all. The present invention may be used in any of these types of gun barrels. The chromium 14 provides a smooth, high hardness surface which minimizes wear of the barrel. As is shown in FIG. 1, the layer of chromium 14 includes a number of cracks 16*a*-16*d* defined therein. These cracks 16 pass through the layer of chromium 14 and expose portions of the surface of the underlying steel alloy 12. These cracks 16 can occur as a result of stresses which arise when the chromium is deposited, and further cracking can occur during use of the gun.

Ignition of a propellant charge creates a volume of high temperature, high pressure, combustion products which propel a projectile through the barrel. These combustion products can be in the form of ions, radicals or neutral species. The cracks 16*a*-16*d* in the chromium layer 14 will permit these combustion products to contact the underlying body of steel 12 so as to cause a chemical reaction to occur between components of the combustion products and the steel. For example, it has been demonstrated that CO, one of a number of reactive combustion products, can react with the steel of gun barrels, under firing conditions, to cause carburization of the steel.

As shown in FIG. 1, portions 18*a*-18*c* of the body of steel 12 have been carburized in the regions of cracks 16*a*-16*d*. Such reactions can adversely change the properties of the steel. For example, typical gun steel has a melting point of approximately 1723° K; however, if the steel is carburized its melting point drops to 1423° K. The lowering of the melting point makes carburized portions of the barrel prone to pitting and other erosion as a result of use of the barrel. Such erosion can spread beneath the chromium layer, as is specifically shown for region 18*b*, thereby causing portions of the chromium layer to form new cracks and/or flake away from the surface of the barrel. This will expose further portions of the steel to the propellant gas leading to further carburization and erosion. Similar reactions can also occur in engines, turbines and the like under high temperature and/or high pressure conditions.

Clearly, there is a need for structures and methods for stabilizing steel alloys against thermochemical corrosion which can occur under severe use conditions. Any such structure and method should be simple to implement and should not interfere with the function of the item. As will be explained in greater detail hereinbelow, the present invention provides such structures and methods.

BRIEF DESCRIPTION OF THE INVENTION

There is disclosed herein a method for enhancing the resistance of a surface of a substrate comprised of a ferrous alloy to thermochemical erosion. The method comprises the step of disposing a layer of a low nitrogen, iron nitride on the surface. The iron nitride is characterized in that the atomic percentage of nitrogen therein is greater than 0 but no more than 20%. In a specific embodiment, the atomic percentage of nitrogen is in the range of 5-20%; and in another particular embodiment, the atomic percentage of nitrogen is at least 10%. In a particular embodiment, the atomic percentage of nitrogen in the layer is in the range of 10-15%.

According to the method, the layer may be formed by various deposition techniques including chemical vapor deposition, plasma-assisted chemical vapor deposition, physical vapor deposition, evaporation, sputtering, photochemically activated deposition, and the like. In another embodiment, the layer is formed by nitriding the underlying steel. Such nitriding may be accomplished by the use of a nitriding gas, by ion implantation, or by other methods known in the art.

In certain embodiments, a layer of a refractory material is disposed atop the nitride layer. The refractory material may comprise one or more metals such as: Ta, Mo, W, V, Ir, Cr and the like. In certain embodiments, Cr is a preferred refractory material.

Also disclosed is a ferrous article having a layer of the foregoing iron nitride material disposed upon it. Specifically disclosed is a gun barrel having the iron nitride layer of this invention disposed upon a surface of its bore.

DETAILED DESCRIPTION OF THE INVENTION

Figure 1:
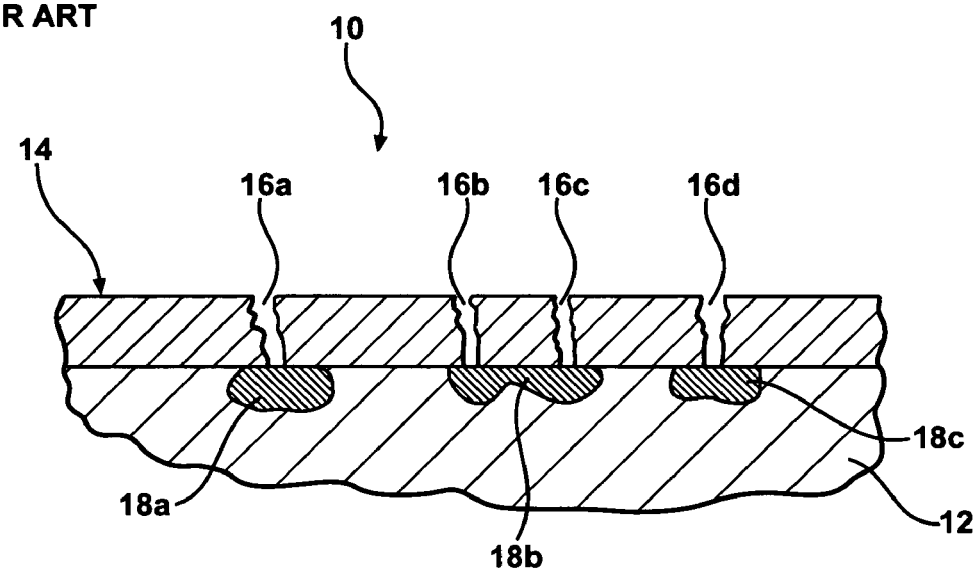
FIG - 1 PRIOR ART
FIG. 1 is a cross section of a portion of a gun barrel having a prior art coating disposed upon a surface of the bore thereof.

The present invention recognizes that steel and other ferrous materials can be protected from thermochemical erosion by a layer of certain low nitrogen, iron nitride materials. These iron nitrides, in contrast to iron nitrides generally employed as protective coatings, are characterized by having a very low content of nitrogen. In general, the nitride layers of the present invention include no more than 20 atomic percent of nitrogen.

In contrast, prior art nitride protective layers such as those discussed in the '588 application cited above are optimized for high hardness and include significantly larger amounts of nitrogen therein. Typically, such layers include at least 33 atomic percent nitrogen. The prior art high hardness nitride layers have very good wear resistance under low temperature and low pressure conditions; however, the present invention recognizes that these materials have relatively low melting points and do not function very well under conditions of high temperature and pressure as are encountered in gun barrels, internal combustion engines, turbines and the like. In fact, the presence of such prior art layers can, in some instances, be detrimental to the service life of particular items.

In contrast to prior art high nitrogen nitrides, the low nitrogen nitrides of the present invention have a melting point which is in excess of 1600° K. In particular, specifically preferred materials of the present invention have a melting point of at least 1680° K, and one specific group of nitrides melts at 1683° K. A phase diagram for the Fe—N system showing materials having these melting points is found in the publication: *Thermodynamic Analysis of the Fe—N System Using the Compound-Energy Model with Predictions of the Vibrational Entropy*, Guillermet et al.; Z. Metallkd. 85 (1994); 154-163.

The nitrides of the present invention generally include nitrogen in an amount greater than 0 and up to 20 atomic percent. In one particular group of materials, the atomic percent of nitrogen is in the range of 5-20%. In specific instances, the nitrogen is present in an amount of at least 10 atomic percent; and in another specific group of embodiments, the atomic percentage of nitrogen is in the range of 10-15%.

In view of the teaching presented herein of the utility and desirability of employing the low nitrogen nitride layers of the present invention, various techniques and methods for the preparation of such layers will be readily apparent to those of skill in the art. For example, the nitride layer may be disposed upon the surface to be protected by various deposition processes such as chemical vapor deposition, plasma-assisted chemical vapor deposition, physical vapor deposition, evaporation, sputtering, photochemically activated deposition and the like. In another group of embodiments, the nitride layer may be formed by reaction of the body of ferrous material with a source of nitrogen. Such techniques for nitriding steels are well known in the art. For example, nitriding may be accomplished by ion implantation. In other instances, nitriding may be accomplished by exposing the steel surface to a nitriding gas which may be activated by electromagnetic radiation in a plasma, by a laser, or by heat. Such gases include one or more of nitrogen, nitrogen oxides, ammonia, amines, hydrazine, or various other nitrogen containing compounds.

Figure 2:
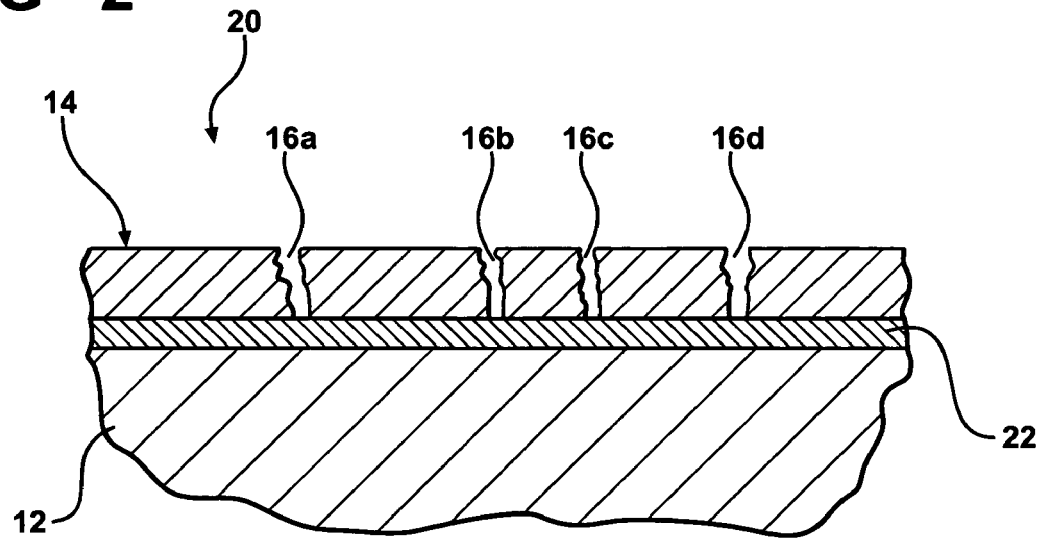
FIG. 2 is a cross-sectional view of a portion of a gun barrel having the coating of the present invention disposed upon a surface of the bore thereof.

Depending upon the particular application, the nitride layer of the present invention may be employed either singly or in combination. In applications where high levels of friction are encountered, as for example in gun barrels, it may be advantageous to include a layer of a high hardness refractory material atop the nitride layer, and one such embodiment is shown in FIG. 2. Referring now to FIG. 2, there is shown a portion of a gun barrel 20 incorporating the protective low nitrogen, nitride layer 22 of the present invention. As is specifically shown in FIG. 2, a gun barrel 20 includes a steel alloy portion 12 defining the bore thereof. The surface of the bore is coated with the low nitrogen, nitride layer 22 of the present invention. Typically, this layer will have a thickness ranging up to approximately 0.05 inch, although it is to be understood that layers having thicker or thinner thicknesses are also within the scope of the present invention. It should also be noted that while FIG. 2 shows the nitride layer 22 as having a sharp interface with the underlying body of steel 12, the composition of the layer 22 may be graded throughout its thickness so that portions of the layer 22 near the body of steel 12 may have a very low nitrogen content (e.g. less than 5 atomic percent) while portions of the layer 22 near to its upper surface may have a higher nitrogen content (e.g. 10-15 atomic percent). The precise configuration of the layer will depend on the process by which it is prepared. Layers formed by nitriding the body of steel will tend to have an at least partially graded structure, while layers deposited from another source may be of a graded or uniform composition. All of such embodiments are within the scope of this invention.

In the FIG. 2 embodiment, the gun barrel 20 also includes a layer of chromium 14 disposed atop the nitride layer 22. As in the FIG. 1 embodiment, the layer of chromium includes a number of cracks **16*a*-16*d* therein. This chromium layer 14** is preferably formed by electroplating; however, other deposition techniques may also be employed. Also, it is to be understood that other refractory materials, including metals, ceramics, glasses, carbon coatings and the like may also be utilized.

When the gun barrel 20 of FIG. 2 is exposed to high temperature, high pressure combustion products, the nitride layer 22 forms a very effective temperature-resistant, inert barrier between the steel 12 and those combustion products. This layer serves to prevent combustion products from contacting and degrading the steel. It has been reported in the literature that iron nitrides can function to prevent the dissociation of CO at an iron surface; and while not wishing to be bound by speculation, the inventors hereof theorize that, in addition to forming a barrier between the steel and combustion products, the nitride layer 22 also functions to further inhibit unwanted chemical reactions therebetween by preventing decomposition of CO, and subsequent carburization of the steel in the gun barrel. The combination of the structural integrity of the layer 22, its thermal resistance, and its function in protecting the underlying steel prevents thermochemical pitting and erosion of the steel 12 and also serves to prevent flaking away and further cracking of the chromium layer.

In addition to the foregoing, a further benefit of the nitride layer in the FIG. 2 embodiment is that the nitride has a Rockwell hardness of approximately 60. Electroplated chrome has a typical hardness of approximately 71-73 Rockwell, while a typical gun steel has a hardness of approximately 36-40 Rockwell. When the relatively high hardness chrome is deposited directly atop the softer steel, cracking can readily occur as a result of hardness mismatch; however, the presence of the intermediate hardness low nitrogen, nitride layer minimizes such cracking.

In summary, the presence of the nitride layer of the present invention in a gun barrel serves to greatly prolong the service life of that barrel by preventing the carburization and subsequent melting point lowering of the gun barrel steel which could lead to pitting, erosion and failure. Also, the presence of the layer enhances the stability and compatibility of an overlying chromium protective layer.

While FIG. 2 shows the nitride layer used in combination with a chromium layer, it may likewise be employed in combination with other types of high hardness and/or high temperature resistant layers. Such layers include refractory materials such as ceramics, glasses, tetrahedral carbon coatings, refractory metals and the like. In addition to chromium, some other refractory metals which may be employed in the present invention include Mo, W, Ta, V and Ir. Also, as noted above, in certain applications the nitride layer may be used alone.

In view of the teaching presented herein, yet other embodiments of the present invention will be readily apparent to one of skill in the art. The foregoing drawings, discussion and description are illustrative of specific embodiments of the present invention, but they are not meant to be taken as limitations upon the practice thereof. It is the following claims, including all equivalents, which define the scope of the invention.

The invention claimed is:

1. A ferrous article having a surface which is resistant to thermochemical erosion, said article comprising:

a layer of an iron nitride which is disposed upon said surface of the article, said iron nitride being characterized in that the atomic percentage of nitrogen therein is greater than 0 but no more than 20%.

2. The article of claim 1, wherein said coating further comprises a layer of a refractory material disposed upon said layer of an iron nitride.

3. The article of claim 2, wherein said refractory material comprises a metal.

4. The article of claim 3, wherein said metal comprises chromium.

5. The article of claim 1, wherein said layer of iron nitride is a uniform composition and not a graded composition.

6. The article of claim 5, wherein said layer of iron nitride is formed by a deposition technique.

7. The article of claim 5, wherein said layer of iron nitride is formed by a deposition technique selected from the group consisting of chemical vapor deposition, plasma-assisted chemical vapor deposition, physical vapor deposition, evaporation, sputtering, and photochemically activated deposition.

8. A gun barrel having enhanced resistance to thermochemical erosion, said gun barrel comprising:

a bore having a surface comprised of a steel alloy; and a layer of an iron nitride disposed upon the surface of said bore, said iron nitride being characterized in that the atomic percentage of nitrogen therein is greater than 0 but no more than 20%.

9. The gun barrel of claim 8, wherein the atomic percent of nitrogen in said layer is in the range of 5-20%.

10. The gun barrel of claim 8, wherein the atomic percent of nitrogen in said layer is at least 10%.

11. The gun barrel of claim 8, wherein the atomic percent of nitrogen in said layer is in the range of 10-15%.

12. The gun barrel of claim 8, wherein the melting point of said layer of iron nitride is at least 1600° K.

13. The gun barrel of claim 8, wherein the melting point of said layer of iron nitride is at least 1680° K.

14. The gun barrel of claim 8, wherein said layer of an iron nitride has a thickness which ranges up to 0.05 inch.

15. The gun barrel of claim 14, wherein said layer of iron nitride is a uniform composition and not a graded composition.

16. The gun barrel of claim 8, further including a layer of a refractory material disposed atop the layer of said iron nitride.

17. The gun barrel of claim 16, wherein said refractory material comprises a refractory metal.

18. The gun barrel of claim 17, wherein said refractory metal is selected from the group consisting of: Ta, Mo, W, Ir, V, Cr and combinations thereof.

19. The gun barrel of claim 17, wherein said refractory metal comprises chromium.

20. A method for enhancing the resistance of a surface of a substrate comprised of a ferrous alloy to thermochemical erosion, said method comprising the step of:

disposing a layer of an iron nitride on said surface, said iron nitride being characterized in that the atomic percentage of nitrogen therein is greater than 0 but no more than 20%.

21. The method of claim 20, wherein the atomic percent of nitrogen in said layer is in the range of 5-20%.

22. The method of claim 20, wherein the atomic percent of nitrogen in said layer is at least 10%.

23. The method of claim 20, wherein the atomic percent of nitrogen in said layer is in the range of 10-15%.

24. The method of claim 20, wherein the melting point of said layer of iron nitride is at least 1600° K.

25. The method of claim 20, wherein the melting point of said layer of iron nitride is at least 1680° K.

26. The method of claim 20, wherein said layer of an iron nitride has a thickness which ranges up to 0.050 inch.

27. The method of claim 20, wherein said step of disposing said layer of an iron nitride on the surface comprises forming said layer by a process selected from the group consisting of: chemical vapor deposition, plasma-assisted chemical vapor deposition, physical vapor deposition, evaporation, sputtering, photochemically activated deposition, and combinations thereof.

28. The method of claim 20, wherein the step of disposing a layer of an iron nitride on the surface comprises exposing said surface to a source of nitrogen so that said surface reacts with said nitrogen to form the iron nitride.

29. The method of claim 28, wherein said source of nitrogen comprises a nitriding gas, and wherein said method includes the step of activating said nitriding gas so as to cause said nitriding gas to react with the substrate.

30. The method of claim 29, wherein said nitriding gas includes a member selected from the group consisting of: nitrogen, oxides of nitrogen, ammonia, hydrazine, amines, and combinations thereof.

31. The method of claim 20, including the further step of disposing a coating of a refractory material atop said layer of an iron nitride.

32. The method of claim 31, wherein said refractory metal is selected from the group consisting of: Ta, Mo, W, Ir, V, Cr and combinations thereof.

33. The method of claim 31, wherein said refractory material comprises a refractory metal.

34. The method of claim 33, wherein said refractory metal is chromium.

35. The method of claim 34, comprising the further step of electroplating said coating of chromium atop said layer of an iron nitride.

* * * * *